US011618655B2

(12) United States Patent
Pinel et al.

(10) Patent No.: US 11,618,655 B2
(45) Date of Patent: Apr. 4, 2023

(54) CAMERA-ASSISTED CRANE SAFETY

(71) Applicant: International Business Machines Corporation, Armonk, NY (US)

(72) Inventors: Florian Pinel, New York, NY (US); Peter Alan Coldicott, Jonestown, TX (US); Russell Patrick Bobbitt, New York, NY (US)

(73) Assignee: International Business Machines Corporation, Armonk, NY (US)

( * ) Notice: Subject to any disclaimer, the term of this patent is extended or adjusted under 35 U.S.C. 154(b) by 993 days.

(21) Appl. No.: 16/367,326

(22) Filed: Mar. 28, 2019

(65) Prior Publication Data

US 2020/0307965 A1 Oct. 1, 2020

(51) Int. Cl.

| | |
|---|---|
| ***B66C 13/46*** | (2006.01) |
| ***B66C 13/16*** | (2006.01) |
| ***B66C 23/90*** | (2006.01) |
| ***B66C 15/04*** | (2006.01) |

(52) U.S. Cl.

CPC ..... *B66C 13/46* (2013.01); *B66C 13/16* (2013.01); *B66C 15/045* (2013.01); *B66C 23/905* (2013.01)

(58) Field of Classification Search

CPC ..... B66C 13/16; B66C 15/045; B66C 23/905; B66C 13/46

See application file for complete search history.

(56) References Cited

U.S. PATENT DOCUMENTS

| | | | | |
|---|---|---|---|---|
| 3,138,357 | A | 6/1964 | Whitwell | |
| 7,167,575 | B1 | 1/2007 | Nichani | |
| 7,378,947 | B2 | 5/2008 | Daura Luna | |
| 2010/0090829 | A1 | 4/2010 | Pujol | |
| 2012/0119907 | A1 | 5/2012 | Teuchert | |
| 2013/0299440 | A1* | 11/2013 | Hermann | B66C 15/065 340/8.1 |
| 2014/0092249 | A1 | 4/2014 | Freiburger | |
| 2015/0161872 | A1* | 6/2015 | Beaulieu | B66C 13/40 340/686.6 |
| 2015/0249821 | A1 | 9/2015 | Tanizumi | |
| 2015/0329333 | A1 | 11/2015 | Fenker | |
| 2016/0031681 | A1* | 2/2016 | Delplace | B66C 15/06 345/420 |

(Continued)

FOREIGN PATENT DOCUMENTS

| | | | |
|---|---|---|---|
| CN | 104507847 | B | 5/2016 |
| JP | 2010241548 | A | 10/2010 |

OTHER PUBLICATIONS

"Port Machinery Sensing Solutions," Banner Engineering, accessed Mar. 8, 2019, 8 pages. <http://info.bannerengineering.com/cs/groups/public/documents/literature/160581.pdf>.

(Continued)

*Primary Examiner* — Ig T An

(74) *Attorney, Agent, or Firm* — Brian Welle

(57) ABSTRACT

Aspects of this disclosure relate to a system that uses images of a load handled by a crane as captured by cameras to monitor the load. The images may include different sets of outer perimeters of the load. The system may identify the outer perimeters and then define a safety zone that extends beyond these outer perimeters. In response to identifying an object within the safety zone, the system may execute a remedial action.

20 Claims, 3 Drawing Sheets

(56) References Cited

U.S. PATENT DOCUMENTS

| | | | | |
|---|---|---|---|---|
| 2018/0179029 | A1 | 6/2018 | Schoonmaker | |
| 2020/0255267 | A1 * | 8/2020 | Wong | B60Q 9/00 |

OTHER PUBLICATIONS

"TAC-3000 Crane Anti-Collision Systems," OptiCrane Inc., web page captured Apr. 3, 2018, 10 pages. <https://web.archive.org/web/20180403204951/https://opticrane.com/tac-3000-crane-anti-collision-safety-viewing-systems/>.

"X2 Crane Camera," Blokcam, printed Mar. 8, 2019, 12 pages. <https://www.blokcam.com/us/products/crane-camera/>.

Abderrahim et al., "A Mechatronics Security System for the Construction Site," ISARC2003: The Future Site, Proceedings of the 20th International Symposium on Automation and Robotics in Construction, Sep. 21-24, 2003, pp. 155-160. <https://pure.tue.nl/ws/files/2466647/570755.pdf#page=158>.

Estrada et al., "Multi-Scale Contour Extraction Based on Natural Image Statistics," Proceedings of the 2006 Conference on Computer Vision and Pattern Recognition Workshop (CVPRW'06), Jun. 17-22, 2006, 8 pages. <http://www.cs.toronto.edu/~strider/publications/POCV_multiscale.pdf>.

He et al., "Mask R-CNN," Facebook AI Research (FAIR), Jan. 24, 2018, pp. 1-12. <https://arxiv.org/pdf/1703.06870.pdf>.

Ruff, "Innovative Safety Interventions: Feasibility of Using Intelligent Video for Machinery Applications," CDC, National Institute of Occupational Safety and Health, Spokane, Washington, accessed Mar. 8, 2019, 5 pages. <https://www.cdc.gov/niosh/mining/UserFiles/works/pdfs/isifo.pdf>.

Yang et al., "Object Contour Detection with a Fully Convolutional Encoder-Decoder Network," The IEEE Conference on Computer Vision and Pattern Recognition (CVPR), Mar. 15, 2016, 10 pages. <https://arxiv.org/pdf/1603.04530.pdf>.

* cited by examiner

CAMERA-ASSISTED CRANE SAFETY

BACKGROUND

The present disclosure relates to mechanical cranes, and more specifically, to safety systems for cranes. Construction projects involving the use of cranes are becoming increasingly ubiquitous. These projects may involve the cranes moving around loads that may weigh many tons. Cranes may be capable of moving loads around in three dimensions. As such, there may be an increased need for safety systems to ensure that these loads do not harm or get harmed by other objects in the three-dimensional area within which the crane is moving the load.

SUMMARY

Aspects of this disclosure relate to a method that includes receiving a first image of a load of a crane from a first camera secured to the crane. The first image depicts the load and a vicinity of the load adjacent a first set of perimeters of the load that are visible from the first camera. The method further includes receiving a second image of the load from a second camera secured to the crane. The second image depicts the load and the vicinity of the load adjacent a second set of perimeters of the load visible from the second camera. The second set of perimeters includes at least one additional perimeter in comparison to the first set of perimeters. The method further includes identifying, by a processor, the first and second sets of perimeters of the load by analyzing the first and second images using visual recognition techniques. The method further includes defining, by the processor, a three-dimensional safety zone of the load that extends beyond perimeters of the first and second set of perimeters. The method further includes identifying, by the processor analyzing the first and second image, an object in the safety zone. The method further includes executing, by the processor, a remedial action in response to identifying the object in the safety zone.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1A:
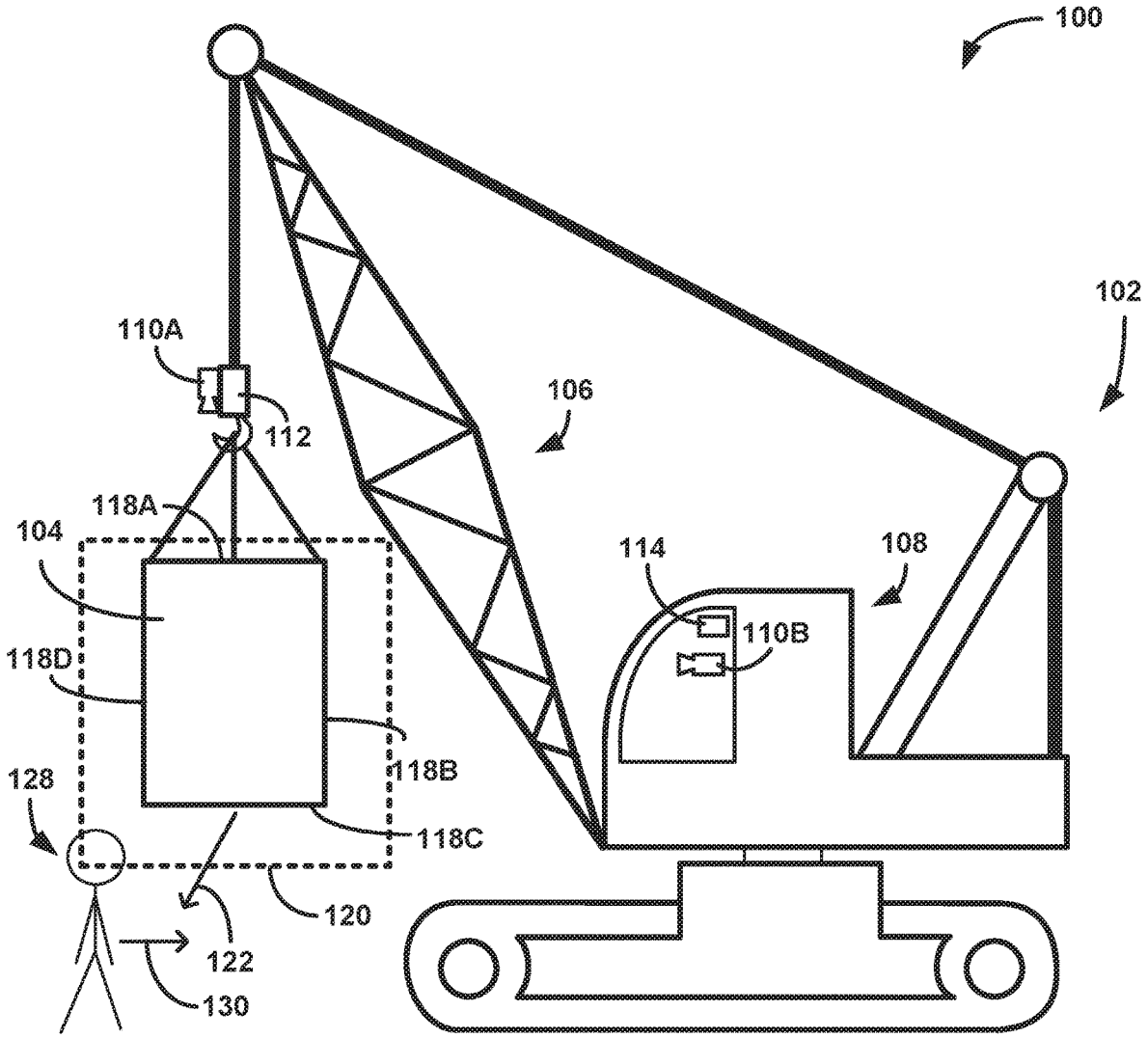
FIG. 1A depicts a conceptualization of an example scenario with an object in a safety zone of a load handled by a crane that includes a first and second camera.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to safety systems for mechanical devices, more particular aspects relate to safety systems for cranes that utilize a computing system communicatively coupled to a plurality of cameras to reduce or eliminate safety concerns that may arise from objects contacting a load that is being moved by the crane. While the present disclosure is not necessarily limited to such applications, various aspects of the disclosure may be appreciated through a discussion of various examples using this context.

Large machines such as cranes may be able to generate a substantial amount of force and momentum, such that it may be advantageous to create safety systems to reduce the likelihood that the force does not impact a person or object and cause damage to the person, object, and/or machine. Cranes as discussed herein may refer to machines that are configured to move an arm or "jib" (jib used predominantly herein) to move heavy or otherwise cumbersome loads. For example, cranes may be used to move loads on construction sites, warehouses, or ports. Loads as discussed herein may refer to items or materials that are being transported from one location to another using the cranes. Though cranes are discussed predominantly herein, it is to be understood that other machines that are configured to move a mechanical arm or jib to move a load (such as digging machines or the like) may utilize aspects of this disclosure.

In some examples, a load may be attached to a jib and a hoist using a hook. Further, a crane operator seated in a cabin of the crane may operate the jib and hoist to move the load to the desired location. In some examples, during use of the crane to move the load, it may be difficult or impossible for the operator to determine the distance between the load and potential obstacles along the x, y, and z axes. For example, obstacles may include terrain such as a mound of dirt, equipment such as a car or cart or the like, or humans such as another worker. Other types of obstacles or objects that pose safety concerns are possible in other examples.

In some examples, one or more sensors may be attached to the load itself in order to assist the operator to identify and/or account for potential obstacles. For example, a camera or infrared distance/proximity sensor or the like may be attached to the load. However, attaching a sensor to the load itself may be a very time-consuming step for an operator, as the operator would need to attach/remove the sensors from the load for each load that the crane moves. This amount of time that would be "wasted" would be further compounded by the fact that numerous sensors would need to be attached to the load, as modern cranes may move loads in substantially each direction (e.g., such that a single sensor would be unlikely to detect all possible obstacles that might be in the trajectory of a load along a full path). Further, sensors would need to be configured to be substantially more robust (e.g., shock-resistant) and therein expensive if the sensors were to be attached to the load. Sensors would need to be robust in order to reduce the likelihood that these sensors would be destroyed in the event of any collision of the load with an obstacle. Additionally, it may be difficult for a sensor to detect all kinds of obstacles when attached to a load, as obstacles may be stationary, moving, and nearly any size or color, such that a sensor would need to have a relatively large computational ability to detect all kinds of obstacles while avoiding corresponding "false positives."

Aspects of this disclosure relate to a safety system that includes a computing system and at least two cameras to determine if a load of a machine is about to intersect with an object that may pose a safety risk to any of the load, machine, or the object. For example, the machine may be a crane, and the crane may include a first camera that is secured to an end of the jib (e.g., a hoist that is deployable from the end of the jib) and a second camera that is secured within a cabin of the crane. The camera may be a wide-area camera, though other types of cameras may be used in other examples. The two cameras may both be configured to communicate (e.g., hard-wired or wirelessly) with a computing system that is configured to analyze images (e.g., still images and/or frames of a video feed) from the two cameras. The computing system may identify the outer perimeter of the load being moved by the jib. The computing system may further identify a "safety zone" that extends beyond the outer perimeter of the load, where an object within the safety zone may pose a safety hazard to either the machine or the object. The computing system may account for such variables as a direction in which the load is moving, a direction in which the object is moving, or the like.

The computing system may determine if identified features of the images are objects within the safety zone such that a risk is posed to any of the load, the machine, or the object. For example, the computing system may execute visual recognition techniques on identified features (e.g., where a feature is identified by a group of localized pixels that are colored different and/or represent a moving item compared to adjacent pixels) to determine if the feature represents an object that might damage the load or machine, and/or if the feature represents an item that is not worth considering (e.g., if the feature is a piece of trash or the like). If the computing system determines that the feature represents an object that may pose a safety risk to itself or the machine or load as a result of being in the safety zone, the computing system may execute a remedial action. The remedial action may include generating an alarm such as a light or a noise. Additionally, or alternatively, the remedial action may include causing the jib to move away from the object, or to stop moving toward the object.

For example, FIG. 1A depicts scenario 100 with crane 102 moving load 104 using jib 106. It is to be understood that the general shape and relative size of features of FIG. 1A such as crane 102, load 104, and jib 106 are depicted for purposes of illustration only, as aspects of this disclosure may relate to different types of cranes (or machines other than cranes as discussed herein) with different types of arms (e.g., including cranes with more than one arm, or arms that articulate in more directions) with different shapes of loads. Jib 106 as discussed and depicted herein may include a moveable segment of crane 102. For example, jib 106 may be configured to move along a variety of axes relative to crane 102. In some examples, jib 106 may include one or more joints that enable one length of jib 106 to articulate relative to another length of jib 106.

Jib 106 may extend away from cabin 108 of crane 102. Cabin 108 may be configured to partially or fully encloses a human operator. For example, cabin 108 may be define a room in which a human operator may sit or stand while operating crane 102. Alternatively, cabin 108 may define a pedestal or the like with walls or fences that partially enclose an area in which a human operator may sit or stand while operating crane 102.

Cameras 110A, 110B (collectively, "cameras 110") may monitor load 104. In some examples, one camera 110A may be secured to hoist 112 that is configured to extend from jib 106. Camera 110A that is secured to hoist 112 may be secured to substantially any surface of hoist 112, so long as a lens of camera 110A has a substantially unobstructed view of load 104 (e.g., unobstructed by hoist 112 or other non-moving elements of crane 102). Camera 110A may be secured to crane 102 in such a way that camera 110A may be used to monitor a "horizontal plane" of load 104, such that camera 110A may detect things that pose a safety concern to load 104 along a plane that extends substantially parallel to the ground. It is to be understood that even though camera 110A is depicted as secured to hoist 112 for purposes of illustration that camera 110A may be secured to substantially any surface of crane 102 so long as camera 110A has a relatively unobscured view of this horizontal plane of load 104.

As depicted in FIG. 1A, camera 110B may be secured to cabin 108. Camera 110B may be secured to substantially any surface of cabin 108, so long as a lens of camera 110B has a substantially unobstructed view of load 104, similar to camera 110A. Camera 110B as depicted may be secured to crane 102 in such a way that camera 110B may be used to monitor a "vertical plane" of load 104, such that camera 110B may detect things that pose a safety concern to load 104 along a plane that extends substantially perpendicular to the ground. Similar to camera 110A, it is to be understood that even though camera 110B is depicted as secured to cabin 108 for purposes of illustration that camera 110B may be secured to substantially any surface of crane 102 so long as camera 110B has a relatively unobscured view of this vertical plane of load 104.

In other examples (not depicted), camera 110A may be secured to another portion of crane 102, or camera 110A may be secured to a surface outside of crane 102 such that a lens of camera 110A may view a plurality of cranes similar to crane 102. As discussed herein, it may be advantageous for both cameras 110 to view load 104 from substantially different angles to better detect potentially less safe situations and react accordingly. For example, it may be advantageous for camera 110A to have a direct line of sight to a different side of load 104 than camera 110B, to potentially increase the likelihood that a potential safety concern may be identified. Further, in a setting where numerous cranes will be used, it may be more cost effective to use a single camera 110A to capture a first view, while a second camera 110B attached to cabin 108 or the like of respective cranes 102 captures a second view. For example, a single camera 110A may be secured to a light pole or the wall of a building or some relatively tall point where camera 110A may capture a top-down view of respective cranes 102.

Figure 1B:
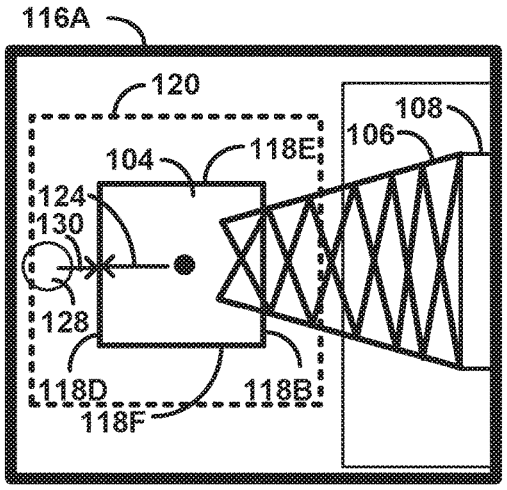
FIG. 1B depicts an example first image of the scenario of FIG. 1A captured by the first camera of FIG. 1A.
Figure 1C:
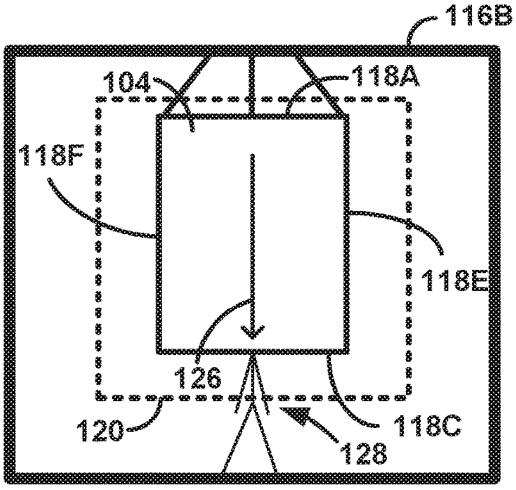
FIG. 1C depicts an example second image of the scenario of FIG. 1A captured by the second camera of FIG. 1A.

Controller 114 may be configured to receive images from cameras 110. In some examples, cameras 110 may be hard-wired to controller 114. In other examples, cameras 110 may be wirelessly coupled to controller 114 (e.g., via Bluetooth® or near field communication (NFC) or the like). For example, FIGS. 1B and 1C depicts images 116A, 116B (collectively, "images 116") received from cameras 110. Image 116A is captured by from camera 110A, and image 116B is captured by camera 110B.

Using images, controller 114 may determine outer perimeters 118A-118F (collectively, "outer perimeters 118") of load 104. As used herein, outer perimeters 118 of load 104 may include the outer-most surfaces of load 104. In some examples, controller 114 may identify substantially all outer perimeters 118 of load 104, whereas in other examples controller 114 may identify only a subset of outer perimeters. Whether or not controller 114 identifies some or all outer perimeters 118 may depend upon a number and an orientation of cameras 110, such that increasing an amount (or otherwise optimizing an orientation) of cameras 110 may increase a likelihood that controller 114 is capable of identifying more or all outer perimeters 118. In some examples, securing cameras 110 in a way to increase a number of outer perimeters 118 that controller 114 is capable of identifying may increase an ability of controller 114 to provide safety measures related to crane 102 operation as discussed herein. Relatedly, securing a first camera 110A to a hoist 112 such that the first camera 110A is generally looking down on load 104 during operation while securing a second camera 110B to cabin 108 such that the second camera 110B is generally looking horizontally at load 104 along a plane that is generally parallel with the ground may increase an ability of controller 114 to identify outer perimeters 118.

Once controller 114 identifies outer perimeters, controller 114 may determine safety zone 120. Safety zone 120 may be an area of substantially empty space that extends out from outer perimeters 118 of load 104 in most or all directions. Safety zone 120 may be a three-dimensional space area in which controller 114 determines that it is unsafe for some objects to occupy (e.g., such that it may be safe for the same object to occupy space that is immediately outside of safety zone 120).

Figure 2:
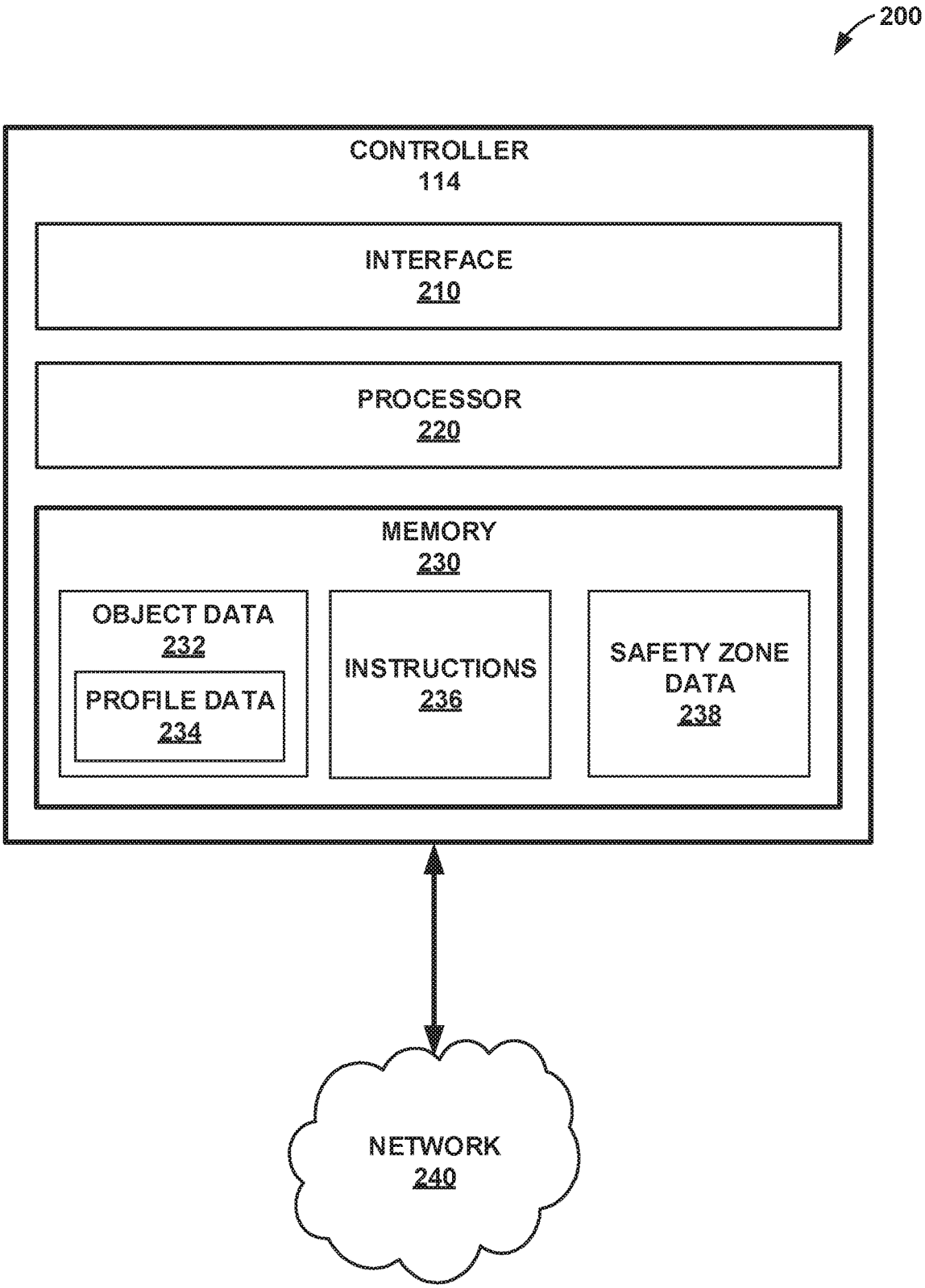
FIG. 2 depicts a conceptual and schematic diagram of an example system configured to execute a remedial action in response to detecting an object in a safety zone of a load handled by a crane.

In some examples, safety zone 120 may extend out a predetermined distance (e.g., a distance saved as safety zone data 238 of memory 230 of controller 114 as discussed in greater detail below with relation to FIG. 2) from load 104 in most or all directions (e.g., along most of all axes). For example, safety zone 120 may extend out a meter from each outer perimeter 118 of load 104, such that if load 104 defines a rectangular volume that measures two meters by two meters by three meters, safety zone 120 may be determined to define a rectangular that measured four meter by four meter by five meter rectangle to fully encompass load 104. In other examples, safety zone 120 may extend out different predetermined distances from load 104 in different directions. For example, safety zone 120 may extend out a meter below load 104 but only extend out 10 centimeters from a "top" surface of load 104 (e.g., a surface that is relatively closest to camera 110A secured to hoist 112, which is outer perimeter 118A of FIG. 1A), as it may be more likely that a safety concern would be present below load 104 rather than above load 104 (e.g., due to gravity).

In some examples, controller 114 may dynamically generate safety zone 120 as load 104 is moved by crane 102, such that controller 114 may modify or update outer bounds of safety zone 120 for load 104 over time depending upon changing data of images 116. For example, controller 114 may determine that load 104 is moving in direction 122. In response to determining that load 104 is moving in direction 122, controller 114 may increase safety zone 120 in a direction that extends out from outer perimeters 118D, 118C that face direction 122. Additionally, or alternatively, controller 114 may condense or shrink safety zone 120 that extends out from outer perimeters 118A, 118B that face away from direction 122. By extending safety zone 120 along a vector that matches direction 122 of movement of load 104, controller 114 may increase an ability to detect unsafe actions (e.g., as it may be more likely that load 104 may hit and damage/be damaged by an object along direction 122 in which load 104 is moving) and respond accordingly as described herein. Further, by shrinking safety zone 120 along vectors that oppose direction 122 of movement of load 104, controller 114 may increase an ability to avoid false positives of safe actions, as it may be relatively less likely for an object to create an unsafe situation due to a proximity of the object to a respective outer perimeter 118 that is moving away from the object.

Controller 114 may determine that load 104 is moving in a direction by tracking a relative location of load 104 over a sequence of images 116 taken by cameras 110 over a duration of time. For example, controller 114 may "stitch" together directional components 124, 126 from images 116 taken from different cameras 110 over time to determine direction 122 of load 104 movement. Additionally, or alternatively, controller 114 may utilize one or more additional sensors attached to hoist 112 or jib 106 or the like that are configured to provide location or movement or momentum readings. For example, controller 114 may receive acceleration information from an accelerometer, oscillation information from an oscillator, velocity information from a speedometer, relative location information from an infrared sensor, or the like to determine a relative location or movement of load 104. Additionally, or alternatively, controller 114 may receive commands as sent by a crane operator to crane 102 to determine a relatively movement direction or location of load 104. For example, a command sent by a crane operator using a steering user interface (e.g., such as a wheel, dial, lever, button, foot pedal, radio control, joystick, screen, or the like) to lower load 104 may be sent to controller 114 such that controller 114 may know that load 104 is being lowered.

Controller 114 may identify object 128. As depicted in FIGS. 1A-1C, object 128 may be a human. In other examples object 128 may be another machine or a pile of materials or the like. Object 128 may be a physical thing that might pose a safety risk to itself or to load 104 or crane 102 if object 128 is in safety zone 120. Controller 114 may be configured to determine if features within safety zone 120 are objects 128 to be accounted for or "irrelevant" features to be disregarded. For example, controller 114 may be configured to identify if an identified feature is a piece of garbage, or a meaningless discoloration on the ground, or a bird or insect flying across scenario 100, or a shadow of an object, or some other feature that does not pose a notable safety concern to itself or load 104 or crane 102 by being within safety zone 120.

Controller 114 may determine that object 128 is within safety zone 120. In some examples, controller 114 may only determine that object 128 is within safety zone 120 if controller 114 is able to determine that some of object 128 overlaps with some of safety zone 120 across a plurality of images 116. Configuring controller 114 such that controller 114 only determines that object 128 is within safety zone 120 if more than one of images 116 shows object 128 overlapping with safety zone 120 may reduce a possibility of "false positives" where controller 114 reacts as if there is a safety concern where there actually is not one (e.g., but rather it was a perception or depth flaw where object 128 looked like it was in safety zone 120 in one image but actually was not). In other examples, controller 114 may be configured to determine that object 128 is within safety zone 120 if at least one of images 116 includes an overlap of safety zone 120 and object 128. Configuring controller 114 such that controller 114 may determine that object 128 is within safety zone 120 even if only one of images 116 shows object 128 in safety zone 120 may increase an ability of controller 114 to identify each time that object 128 is within safety zone 120 (e.g., where object 128 is entirely "below"

load 104 adjacent outer perimeter 118C and is therein entirely blocked by first camera 110A even where object 128 truly is in safety zone 120).

In some examples, controller 114 may be configured to identify object 128 as a thing that may create a safety concern by matching object 128 to one of a set of predetermined objects 128 as stored or otherwise accessed by controller 114. For example, controller 114 may have access to a memory (e.g., such as memory 230 of controller 114 as depicted and discussed in greater detail with respect to FIG. 2) that stores a predetermined set of objects 128 (e.g., stored as object data 232 of memory 230) such as humans, cars, bulldozers, dirt piles, or the like. Upon detecting a feature such as object 128 within one or more images 116, controller 114 may using visual matching techniques to compare the identified feature to visual profiles stored within or otherwise accessible by controller 114 (e.g., such as stored within profile data 234 of memory 230). In such examples, where controller 114 determines that the identified feature does not match any stored profiles of predetermined objects, controller 114 may determine that the identified feature does not indicate a safety risk.

Additionally, or alternatively, controller 114 may be configured to identify the feature as an object 128 that may create a safety concern by identifying substantially each feature of images 116. For example, controller 114 may store any unidentified feature to an online repository of images (e.g., such as a repository accessible over network 240 of FIG. 2). Once identified, controller 114 may analyze characteristics of the identified feature to determine if the feature indicates a safety risk.

In some examples, controller 114 may track a movement of object 128. For example, controller 114 may determine that object 128 is moving in direction 130. Controller 114 may determine that object 128 is moving in a substantially similar manner to how controller 114 determines that load 104 is moving. For example, controller 114 may determine that object 128 is moving by determining that a relative location of object 128 within a sequence of images 116 from one or both cameras 110 is changing.

Where controller 114 determines that object 128 is moving in direction 130 toward load 104, controller 114 may increase safety zone 120 along respective outer perimeters 118D, 118C that face toward direction 130 in which object 128 is moving. Put differently, controller 114 may be configured to increase a size of safety zone 120 to extend toward object 128 when object 128 is moving toward load 104. In some examples, controller 114 may extend safety zone a predetermined amount (e.g., an amount stored within safety zone data 238 of memory 230 of FIG. 2). In other examples, controller 114 may extend safety zone 120 an amount that is proportion to a speed of object 128. Put differently, controller 114 may extend safety zone 120 more toward object 128 the faster that object 128 is moving toward safety zone 120. Controller 114 may determine a relative speed of object 128 by identifying a relative change of location over a change of time as determined by a sequence of images 116 taken by one or both cameras 110.

If controller 114 determines that object 128 is within safety zone 120, controller 114 may execute a remedial action. A remedial action may be an action that is constructed to provide a remedy to the potentially unsafe situation where object 128 is within safety zone 120, such that a danger to object 128, load 104, and/or crane 102 is reduced. For example, controller 114 may generate an alarm such as a flashing light or a klaxon or the like. For another example, controller 114 may cause load 104 to stop moving, or to move in a direction away from object 128, or the like. Controller 114 may cause load 104 to stop moving or to move in or more directions using jib 106 (or other portions of crane 102). In some examples, controller 114 may override commands from a crane operator when causing load 104 to stop moving or to move in one or more directions.

In some examples, controller 114 may be part of a computing system that is, e.g., configured to interact with devices external to crane 102. For example, FIG. 2 is a conceptual and schematic diagram of system 200 that includes controller 114. While controller 114 is depicted as a single entity (e.g., within a single housing) for the purposes of illustration, in other example controller 114 may include two or more discrete physical systems (e.g., within two or more discrete housings). Controller 114 may include interfaces 210, processor 220, and memory 230. Controller 114 may include any number or amount of interface 210, processor 220, and/or memory 230.

Controller 114 may include components that enable controller 114 to communicate with (e.g., send data to and receive and utilize data transmitted by) devices that are external to controller 114. For example, controller 114 may include interface 210 that is configured to enable controller 114 and components within controller 114 (e.g., such as processor 220) to communicate with entities external to controller 114. Specifically, interface 210 may be configured to enable components of controller 114 to communicate with, e.g., cameras 110, crane 102, and any sensors attached to jib 106 (e.g., such as speed, acceleration or positional sensors as described herein). Interface 210 may include one or more network interface cards, such as Ethernet cards, and/or any other types of interface devices that can send and receive information. Any suitable number of interfaces may be used to perform the described functions according to particular needs.

As discussed herein, controller 114 may be configured to determine and monitor safety zones of a crane, such as described above. Controller 114 may utilize processor 220 to monitor and improve safety. Processor 220 may include, for example, microprocessors, digital signal processors (DSPs), application specific integrated circuits (ASICs), field-programmable gate arrays (FPGAs), and/or equivalent discrete or integrated logic circuit. Two or more of processor 220 may be configured to work together to determine and monitor safety zones of a crane.

Processor 220 may determine and monitor safety zones of a crane according to instructions 236 stored on memory 230 of controller 114. Memory 230 may include a computer-readable storage medium or computer-readable storage device. In some examples, memory 230 may include one or more of a short-term memory or a long-term memory. Memory 230 may include, for example, random access memories (RAM), dynamic random-access memories (DRAM), static random-access memories (SRAM), magnetic hard discs, optical discs, floppy discs, flash memories, or forms of electrically programmable memories (EPROM), or electrically erasable and programmable memories (EEPROM). In some examples, processor 220 may determine and monitor safety zones of a crane according to instructions 236 of one or more applications (e.g., software applications) stored in memory 230 of controller 114.

In addition to instructions 236, in some examples thresholds or the like as used by processor 220 to determine and monitor safety zones of a crane may be stored within memory 230. For example, memory 230 may include a set of predetermined objects as object data 232 for which controller 114 searches for, and/or respective profile data 234 for the object data 232. Further, memory 230 may include safety zone data 238 on predetermined distances or rules for creating safety zones. Other types of data may also be stored within memory 230 for use by processor 220 in determining and monitoring safety zones of a cranes.

In some examples, controller 114 may be directly physically coupled to other components of crane 102 (e.g., hard-wired to cameras 110 and/or controls used by a crane operator to operate crane 102). In other examples, controller 114 may be wirelessly communicatively coupled to other components. For example, interface 210 may enable processor 220 to receive data from one or more cameras 110 via network 240. Further, controller 114 may use network 240 to access (or be accessed by) components or computing devices that are external to system 200. For example, an administrator may use a laptop or the like to update profile data 234 or safety zone data 238 or instructions 236 with which processor 220 determines and monitors safety zones of a crane. Network 240 may include one or more private or public computing networks. For example, network 240 may comprise a private network (e.g., a network with a firewall that blocks non-authorized external access). Alternatively, or additionally, network 240 may comprise a public network, such as the Internet. Although illustrated in FIG. 2 as a single entity, in other examples network 240 may comprise a combination of public and/or private networks.

Figure 3:
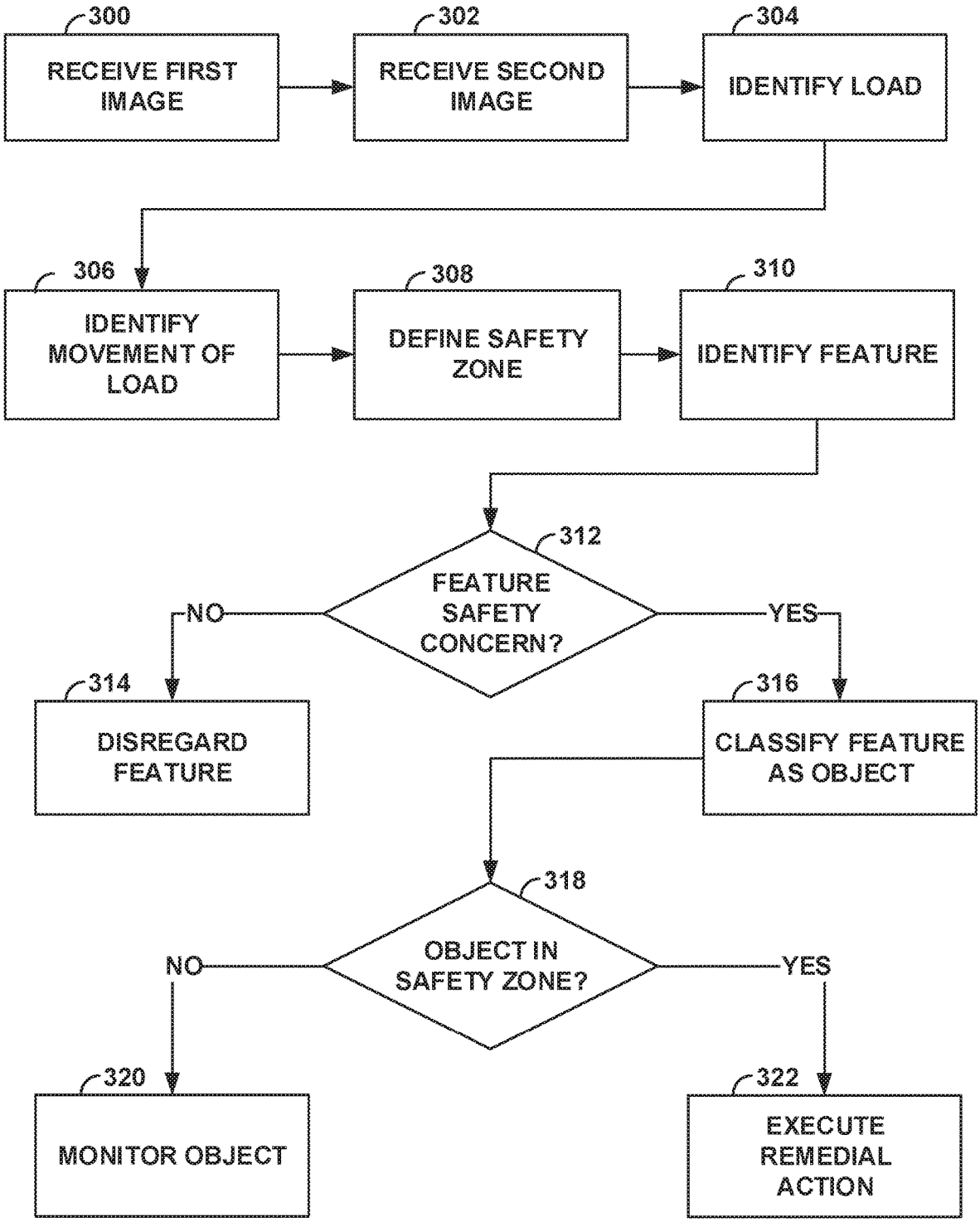
FIG. 3 depicts a flowchart of an example method of executing a remedial action in response to detecting an object in a safety zone of a load handled by a crane.

Using these components, system 200 may determine and monitor safety zones of a crane as discussed herein. For example, controller 114 of system 200 may determine and monitor safety zones of a crane according to the flowchart depicted in FIG. 3. Though the flowchart of FIG. 3 is discussed with relation to the crane 102 and scenario 100 of FIG. 1 and the system 200 of FIG. 2 for purposes of illustration, it is to be understood that the flowchart of FIG. 3 may be executed with other apparatuses or by other controllers in other examples. Further, in other examples crane 102 and/or controller 114 may determine and monitor safety zones according to other methods. For example, items may determine and monitor safety zones of a crane according to more or less operations than are depicted in the flowchart of FIG. 3, and/or determine and monitor safety zones of a crane according to substantially similar steps that are executed in different orders.

Controller 114 may receive first image 116A from first camera 110A (300) and receive second image 116B from second camera 110B (302). Both images 116 may be of a plurality of images sent from cameras 110. For example, cameras 110 may record a live feed of images which are sent to and received by controller 114, which therein analyzes each frame in real-time. Controller 114 may identify load 104 handled by crane 102 in images 116 (304). Controller 114 may identify outer perimeters 118 of load 104 when identifying load 104.

Controller 114 may identify load 104 using a variety of techniques. In some examples, different techniques may have differing levels of accuracy and/or computing efficiency, such that depending upon how much computing power is available and/or how much accuracy is needed one or more techniques may be utilized. For example, where a particularly large or dangerous load is being handled, controller 114 may utilize a more accurate technique. Conversely, where a relatively less dangerous load is being handled in a quicker fashion (e.g., such that subsequent images of a feed may need to be analyzed relatively quicker), a method that is less accurate but requires less power may be used.

One load-identifying technique may include a deep learning semantic segmentation model. This model may be trained on specific types of loads. One example of a technique that utilizes such a model may include assigning categories to each pixel to identify a precise contour of the load as well as the load type. As described herein, a load type may include identifying the material(s) (and therein a general weight and safety hazard) of a load. Another load-identifying technique may include using a deep-learning contour detection model. This deep-learning contour detection model may be configured to accurately identify outer perimeters 118 of respective loads. However, it may be difficult or impossible to identify a load type using this deep-learning contour detection model. Another example of a load-identifying technique may include a deep-learning object detection model. This deep-learning object detection model may be configured to be trained on specific types of loads (e.g., specific container sizes and shapes). Once trained, the deep-learning object detection model may be used to identify loads and return bounding boxes (e.g., a computational shape that includes the respective loads). The deep-learning object detection model may be relatively effective at identifying a load type while coarsely estimating outer perimeters 118 of respective loads. Yet another load-identifying technique includes using a more efficient non-deep learning based approach to find object contours. For example, such a system may be similar to the deep-learning contour detection model described above, but less accurate, therein requiring less computation power. Such a solution may be utilized where computational resources are scarce (e.g., graphics processing units (GPU) are not available).

In some examples, controller 114 may identify dimensions of load 104. Controller 114 may identify these dimensions using a variety of techniques. For example, controller 114 may determine dimensions of load 104 using stereo vision if each of cameras 110 includes 2 lenses. For another example, controller 114 may determine dimensions of load 104 by affixing reference objects of known dimensions onto crane 102, in the field of view of each of cameras 110. Controller 114 may then compare load 104 to the reference objects to determine a size of load 104. When identifying load 104, controller 114 may determine a relative position of load 104. The relative position may include a distance between load 104 and ground. Controller 114 may determine this relative position using the techniques described herein.

Controller 114 may determine direction 122 of movement of load 104 (306). Controller 114 may determine direction 122 of load 104 by identifying a changing relative position of load 104 over a sequence of images 116 taken by one or more cameras 110. In certain examples, controller 114 may determine that load 104 is not moving over images 116 analyzed by controller 114.

Controller 114 may determine safety zone 120 (308). Safety zone 120 may be an area that is greater than the volume of load 104 and extends beyond some or all outer perimeters 118 of load 104. As discussed herein, safety zone 120 may extend out to predetermined distances from predetermined outer perimeters 118 of load 104. Alternatively, safety zone 120 may extend out different lengths from different outer perimeters of load 104. For example, where controller 114 determines that load 104 is moving, controller 114 may extend safety zone 120 along a vector that aligns with direction 122 of movement. For another example, controller 114 may use sensors attached to crane (e.g., such as dynamometer, anemometer, and accelerometer, or the like) to determine a trajectory or even an amplitude of oscillations of load 104 using classical mechanics equations, upon which safety zone 120 may be determined to factor in the trajectory or momentum or oscillations. In some examples, safety zone 120 may be determined to extend no further than some surfaces. For example, as load 104 is being lowered to the ground, controller 114 may be configured to shrink safety zone 120 in a direction toward the ground such that safety zone 120 does not extend into the ground.

Controller 114 may identify a feature of one or more images 116 (310). Controller 114 may identify the feature by analyzing images 116. For example, controller 114 may convert an area around load 104 into areas to be analyzed by images 116 coming from certain cameras 110, where a "horizontal plane" (e.g., a plane that extends substantially parallel to the ground) is monitored using images 116 captured by camera 110A that is substantially above load 104 and looks down upon load 104 during operation. Further, controller 114 may convert an area around load 104 into a "vertical plane" that extends substantially perpendicular to the ground to be monitored using images 116 captured by camera 110B that is substantially level with load 104.

Controller 114 may identify this feature (310) as described herein. For example, controller 114 may determine if the feature matches one or more object profiles. Controller 114 may determine if this feature may relate to a safety concern (312). For example, if controller 114 determines that the feature is a piece of garbage or a butterfly or the like, controller may disregard the feature (314). Disregarding the feature may include tracking the feature and not reacting (e.g., not executing a remedial action) if the feature moves within safety zone 120. Conversely, controller 114 may classify the feature as object 128 that may indicate a safety concern (316). For example, similar to FIG. 1, controller 114 may determine that object 128 is a human to be protected.

Controller 114 may determine if object 128 is in safety zone 120 (318). Controller 114 may use the techniques described herein to determine if object 128 is in safety zone 120. For example, controller 114 may utilize cameras to use an object detection and/or contour deep-learning model (e.g., as described herein) to detect object 128 entering safety zone 120. Using this, controller 114 may use cameras 110 to map the virtual representation of object 128 based on timing, location, and object characteristics (e.g. color). Using such techniques, controller 114 may determine where object 128 is relative to load 104 and safety zone 120.

In some examples, as described above, controller 114 may modify safety zone 120 in response to identifying object 128. For example, controller 114 may extend safety zone 120 toward object 128 if controller determines that object 128 is moving in direction 130 toward safety zone 120. If controller 114 determines that object 128 is not within safety zone 120, controller 114 may track and monitor object 128 (320). For example, controller 114 may track a location and movement of object 128 over subsequent images 116 captured by cameras 110. In some examples, controller 114 may generate a display of safety zone 120 and object 128 and load 104 within cabin 108 of crane 102 as viewable for an operator of crane 102. For example, a screen or monitor may display images 116 and/or a composite three-dimensional display of scenario 100, where safety zone 120 and/or objects 128 are highlighted in one or more vibrant colors (e.g., orange and red, respectively) to be better tracked. In this way, a crane operator may better identify and account for safety concerns when operating crane 102.

Where controller 114 determines that object 128 is in safety zone 120, controller 114 may execute remedial action (322). For example, controller 114 may generate an alert. The alert may be visual and/or audible stimuli. Further the alert may be generated within cabin 108 and/or external to cabin 108. Further, controller 114 may override a manual operation of crane 102. For example, controller 114 may cause load 104 to stop moving, even if a crane operator is sending a command for load 104 movement. For another example, controller 114 may cause load 104 to move in a first direction (e.g., a direction away from object 128) even when a crane operator is sending a command for load 104 to move in a second direction (e.g., a direction toward object 128). Other remedial actions are also possible.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A method comprising:

receiving a first image of a load of a crane from a first camera secured to the crane, wherein the first image depicts the load and a vicinity of the load adjacent a first set of perimeters of the load that are visible from the first camera;

receiving a second image of the load from a second camera secured to the crane, wherein the second image depicts the load and the vicinity of the load adjacent a second set of perimeters of the load visible from the second camera, wherein the second set of perimeters includes at least one additional perimeter in comparison to the first set of perimeters;

identifying, by a processor, the first and second sets of perimeters of the load by analyzing the first and second images using visual recognition techniques;

defining, by the processor, a three-dimensional safety zone of the load that extends beyond perimeters of the first and second set of perimeters;

determining, by the processor, a direction of movement of the load and subsequently shrinking the safety zone along one or more perimeters of the first and second set of perimeters that face away from the direction of movement;

identifying, by the processor analyzing the first and second image, a first object in the safety zone;

disregarding the first object in response to identifying the first object as something that does not pose a notable safety concern as a result of being in the safety zone;

identifying, by the processor analyzing the first and second image, a second object in the safety zone; and executing, by the processor, a remedial action in response to identifying the second object in the safety zone, wherein the remedial action includes autonomously overriding manual operation of the crane to stop movement of the load into the safety zone in response to detecting the second object in the safety zone.

2. The method of claim 1, wherein the first camera is a wide-area camera affixed to a hoist of the crane.

3. The method of claim 1, wherein the second camera is a wide-area camera affixed to a cabin of the crane.

4. The method of claim 1, wherein the remedial action includes generating an alarm.

5. The method of claim 4, wherein the alarm includes visual or audible stimuli within a cabin of the crane.

6. The method of claim 4, wherein the alarm includes visual or audible stimuli near the load.

7. The method of claim 1, wherein the remedial action includes overriding manual operation of the crane to autonomously stop the crane from moving as manual operation is calling for the crane to move.

8. The method of claim 1, wherein the remedial action includes overriding manual operation of the crane to stop movement of the load in response to detecting the second object in the safety zone.

9. The method of claim 1, further comprising the processor extending the safety zone along one or more perimeters of the first and second set of perimeters that are facing the direction of movement.

10. The method of claim 1, further comprising the processor determining a current direction of movement of the second object and extending the safety zone along one or more perimeters of the first and second set of perimeters that are facing the direction of movement of the second object.

11. The method of claim 1, further comprising identify a feature of the first and second images within the safety zone and not executing the remedial action in response to determining that the feature does not indicate a safety concern.

12. A system comprising:

a processor; and a memory in communication with the processor, the memory containing program instructions that, when executed by the processor, are configured to cause the processor to:

receive a first image of a load of a crane from a first camera secured to the crane, wherein the first image depicts the load and a vicinity of the load adjacent a first set of perimeters of the load that are visible from the first camera;

receive a second image of the load from a second camera secured to the crane, wherein the second image depicts the load and the vicinity of the load adjacent a second set of perimeters of the load visible from the second camera, wherein the second set of perimeters includes at least one additional perimeter in comparison to the first set of perimeters;

identify the first and second sets of perimeters of the load by analyzing the first and second images using visual recognition techniques;

define a three-dimensional safety zone of the load that extends beyond perimeters of the first and second set of perimeters;

determine a direction of movement of the load and subsequently shrinking the safety zone along one or more perimeters of the first and second set of perimeters that face away from the direction of movement;

identify a first object in the safety zone by analyzing the first and second image;

disregard the first object in response to identifying the first object as something that does not pose a notable safety concern as a result of being in the safety zone;

identify a second object in the safety zone by analyzing the first and second image; and execute a remedial action in response to identifying the second object in the safety zone, wherein the remedial action includes autonomously overriding manual operation of the crane to stop movement of the load into the safety zone in response to detecting the second object in the safety zone.

13. The system of claim 12, wherein the first camera is a wide-area camera affixed to a hoist secured to an end of a jib of the crane.

14. The system of claim 12, wherein the second camera is a wide-area camera affixed to a cabin of the crane.

15. The system of claim 12, wherein the remedial action includes generating an alarm that includes visual or audible stimuli.

16. The system of claim 12, wherein the remedial action includes overriding manual operation of the crane to autonomously move the load in a first direction as a crane operator is sending a command for the load to move in a second direction.

17. The system of claim 12, wherein the remedial action includes overriding manual operation of the crane to stop movement of the load in response to detecting the second object in the safety zone.

18. The system of claim 12, the memory further comprising instructions configured to cause the processor to extend the safety zone along one or more perimeters of the first and second set of perimeters that are facing the direction of movement.

19. The system of claim 12, the memory further comprising instructions configured to cause the processor to determine a current direction of movement of the second object and extending the safety zone along one or more perimeters of the first and second set of perimeters that are facing the direction of movement.

20. A computer program product, the computer program product comprising a computer readable storage medium having program instructions embodied therewith, the program instructions executable by a computer to cause the computer to:

receive a first image of a load of a crane from a first camera secured to the crane, wherein the first image depicts the load and a vicinity of the load adjacent a first set of perimeters of the load that are visible from the first camera;

receive a second image of the load from a second camera secured to the crane, wherein the second image depicts the load and the vicinity of the load adjacent a second set of perimeters of the load visible from the second camera, wherein the second set of perimeters includes at least one additional perimeter in comparison to the first set of perimeters;

identify the first and second sets of perimeters of the load by analyzing the first and second images using visual recognition techniques;

define a three-dimensional safety zone of the load that extends beyond perimeters of the first and second set of perimeters;

determine a direction of movement of the load and subsequently shrinking the safety zone along one or more perimeters of the first and second set of perimeters that face away from the direction of movement;

identify a first object in the safety zone by analyzing the first and second image;

disregard the first object in response to identifying the first object as something that does not pose a notable safety concern as a result of being in the safety zone;

identify a second object in the safety zone by analyzing the first and second image; and execute a remedial action in response to identifying the second object in the safety zone, wherein the remedial action includes autonomously overriding manual operation of the crane to stop movement of the load into the safety zone response to detecting the second object in the safety zone.

* * * * *